US010738257B2

(12) United States Patent
Hilger et al.

(10) Patent No.: US 10,738,257 B2
(45) Date of Patent: Aug. 11, 2020

(54) FLASHWICK FIRESTARTER

(71) Applicant: White Rabbit LLC, Milwaukee, WI (US)

(72) Inventors: Richard L. Hilger, Milwaukee, WI (US); Michael J. Gehl, Mequon, WI (US)

(73) Assignee: WHITE RABBIT LLC, Milwaukee, WI (US)

( * ) Notice: Subject to any disclaimer, the term of this patent is extended or adjusted under 35 U.S.C. 154(b) by 11 days.

(21) Appl. No.: 15/268,094

(22) Filed: Sep. 16, 2016

(65) Prior Publication Data

US 2017/0088786 A1 Mar. 30, 2017

Related U.S. Application Data

(60) Provisional application No. 62/234,775, filed on Sep. 30, 2015.

(51) Int. Cl.
*C10L 11/06* (2006.01)
*C10L 11/04* (2006.01)

(52) U.S. Cl.
CPC ..... *C10L 11/06* (2013.01); *C10L 11/04* (2013.01); *C10L 2230/06* (2013.01)

(58) Field of Classification Search
CPC ..... C10L 11/04; C10L 11/06; C10L 2230/06
See application file for complete search history.

(56) References Cited

U.S. PATENT DOCUMENTS 2,066,587 A * 1/1937 Swift, Jr. ..... B65D 85/322 217/26.5
2,885,136 A * 5/1959 Grant ..... B65D 85/324 206/521.1
2,997,196 A * 8/1961 Emery ..... B65D 85/322 217/26.5
3,016,176 A * 1/1962 Reifers ..... B65D 85/324 206/521.8
4,627,854 A * 12/1986 Pratt ..... C10L 11/04 44/520

(Continued)

FOREIGN PATENT DOCUMENTS

EP 2060618 A1 * 5/2009 ..... C10L 5/36
EP 2060618 A1 * 5/2009 ..... C10L 5/36
GB 494167 A * 10/1938 ..... B65D 85/322

*Primary Examiner* — Latosha Hines
(74) *Attorney, Agent, or Firm* — Andrus Intellectual Property Law, LLP

(57) ABSTRACT

A firestarter formed from fibrous material and wax supports one or more logs thereon and is used to start a fire. The firestarter includes a body with an upper surface, a lower surface, a length dimension extending between a pair of opposing lateral sides, and a width dimension extending between a pair of opposing front and rear sides defining an periphery of the body. The body of the firestarter includes at least one aperture extending between the lower surface and the upper surface of the body and log supports configured to support at least one log. At least one air inlet is located on the lower surface and at least one flashwick channel extends inwardly from the periphery of the body along the lower surface connecting the air inlet and at least one aperture to define an air channel. It is contemplated that the firestarter may be bundled with logs in a kit for distribution.

17 Claims, 7 Drawing Sheets

(56) References Cited

U.S. PATENT DOCUMENTS

| | | | | |
|---|---|---|---|---|
| 5,290,326 | A * | 3/1994 | Campana | C10L 11/06 44/519 |
| 6,276,531 | B1 * | 8/2001 | Andrews | B65D 85/32 206/511 |
| 7,597,727 | B1 * | 10/2009 | Morris | C10L 5/36 44/531 |
| 2005/0246946 | A1 * | 11/2005 | Paplinski | A47J 37/079 44/544 |

* cited by examiner

FLASHWICK FIRESTARTER

CLAIM FOR THE BENEFIT OF A PROVISIONAL APPLICATION UNDER 35 U.S.C. § 119

This application claims priority to U.S. Provisional Patent Application Ser. No. 62/234,775 filed on Sep. 30, 2015.

STATEMENT OF FEDERALLY SPONSORED RESEARCH OR DEVELOPMENT

Not applicable.

TECHNICAL FIELD

This invention related to structures, products, kits, methods and devices for starting fires and, in particular, structures products, kits, methods and devices for supporting logs or other flammable members which are composed of formed fibrous material.

BACKGROUND

Fires are built in a variety of contexts including, for example, indoors in fireplaces and outdoors in fire pits or on the ground. Among other things, fires can be used to improve the atmosphere of a room, create warmth and light, prepare food, and offer an enjoyable campfire experience.

Conventionally, fires start with an initial ignition and build in strength over time.

When building a fire from scratch, an ignition source such as a match or lighter is typically used to light tinder which may include small, dry items (such as, for example, leaves, lint, twigs, paper, and so forth) that are highly flammable. With the tinder lit by the ignition source, kindling is added to the fire followed by logs or other bulky wood fuel sources. This process of building a fire from natural materials is time-consuming and requires the builder of the fire to have various sized items on hand.

To make fires easier to build, various products have been brought to the market to provide simple solutions for consumers that are interested in building fires.

One such solution is synthetic logs (e.g., pressed sawdust and wax logs). These synthetic logs can be housed in a flammable wrapper and can burn for several hours once lit. However, synthetic logs are vastly more expensive than their natural log counterparts and burn in such a way that it is apparent that they not natural wood.

There are also smaller firestarter blocks that can be made from similar materials. However, such traditional firestarters provide a relatively localized source of flame. When attempting to light natural cord wood, as is now widely available in bundles at many retail stores and gas stations, the use of such firestarter blocks usually does not robustly ignite the logs and requires a significant amount of moving the wood while attempting to start the fire.

Hence, a need exists for improved firestarters that light natural cord wood logs.

SUMMARY

Disclosed herein is a firestarter having a flashwick and log supports that is formed using one of several conventional forming methods, including but not limited to, vacuum forming, thermo-forming, compression forming, and molding from a fibrous mixture of organic and/inorganic materials such as pulp, paper products and wax. The fibrous material that the firestarter is formed with may include paraffin wax or other combustible additions to affect the rate of consumption of the firestarter, such as improving burn time and improving water resistance. The firestarter may also include additional combustible accelerants or flash (i.e. frayed fibrous material) at one or more locations on the body to aid in initial ignition of the firestarter. The fibrous material may also be further blended with other or additional fibrous materials, such as for example, recycled cardboard, recycled newspaper, or other fiber sources like bamboo. In one embodiment, the blend of fibrous materials and wax is 40% to 50% by weight cardboard, 10% to 30% by weight newsprint, and 20% to 40% wax paper. In another embodiment, the blend of fibrous materials and wax is 50% by weight cardboard, 20% by weight newsprint, and 30% wax paper. In another embodiment, the blend of fibrous materials comprises 100% virgin and/or recycled wax paper.

The firestarter includes a log-supporting body that is combustible and facilitates starting a fire beneath the logs which it supports. The structural integrity of the body is maintained for a sufficient length of time after ignition such that the firestarter continues to support the logs until the logs themselves have started on fire, at which point the consumed body of the firestarter is reduced to ash and a fire is started. It is contemplated that a firestarter of the type described herein may be bundled with logs for distribution.

The body has a top surface, a bottom surface, a length dimension extending between a pair of opposing lateral sides, and a width dimension extending between a pair of opposing front and rear sides that may be formed to include one or more of the advantageous features described herein. The opposing lateral sides and the opposing front and rear sides define an periphery of the body. A pair of log supports formed proximate the pair of opposing lateral sides adjacent to the periphery and support one or more logs thereon. At least one foot is formed in the body to support the firestarter on a surface. In one embodiment, a plurality of feet are located adjacent the lateral sides of the body to define a lower resting plane for the firestarter. The body may also include, in some embodiments, downwardly stepped regions extending laterally from a central portion of the body towards the periphery. In one embodiment, the pair of log supports are at greater height than the downwardly stepped portions.

The firestarter body may also include one or more air channels formed under the lower surface of the body leading from one or more inlets to one or more apertures to help move air beneath the fire to promote the introduction of additional oxygen. The one or more apertures extend between the lower surface and the upper surface to permit air flow from the bottom surface to the top surface. In one embodiment, at least one flashwick channel extends inwardly from the periphery of the body along the lower surface and is connected to at least one air inlet and at least one aperture to define one of the air channels. In one embodiment, the flashwick channel is centrally located and extends between opposing sides of the periphery of the body. In this embodiment, the body may include at least one downwardly stepped region from the flashwick channel towards the periphery. A portion of the flashwick channel may include accelerant or flash to aid in ignition. A portion of the flashwick channel located at an outer periphery of the body may be formed to a thickness of 1/128ths of an inch to 3/8ths of an inch to further aid in ignition. In one embodiment, the flashwick channel may extend between a first lower air inlet formed on a first lateral side and a second lower air inlet formed on a second, opposing lateral side to provide an air channel extending between opposing lateral sides. In another embodiment, the flashwick channel extends between a first lower air inlet formed on the front side and a second lower air inlet formed on the rear side to provide an air channel extending between the front and rear sides. In yet another embodiment, at least one aperture is located at a greater height relative to the feet than the air inlets, such that any air traveling from the air inlets to the aperture rises along the air channel.

The firestarter body may further include at least one auxiliary aperture extending between the lower surface and the upper surface. When the firestarter includes at least one downwardly stepped region from central portion of the body towards the periphery, at least one auxiliary chimney may be formed on at least one of the downwardly stepped regions. The firestarter may also include a plurality of depressions on the lower surface of the body defining auxiliary air channels from an air inlet to the at least one auxiliary aperture.

According to another aspect, a kit is disclosed which includes a plurality of logs bundled with firestarter of the type described herein. The logs are placed on the log supports of the firestarter and bundled together with the firestarter using a web of material, such as plastic, nylon webbing or other suitable web material for bundling. According to still another aspect, a related method of starting a fire from at least one log using the firestarter is disclosed. The method includes placing at least one log on the pair of log supports of the firestarter and igniting the firestarter.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
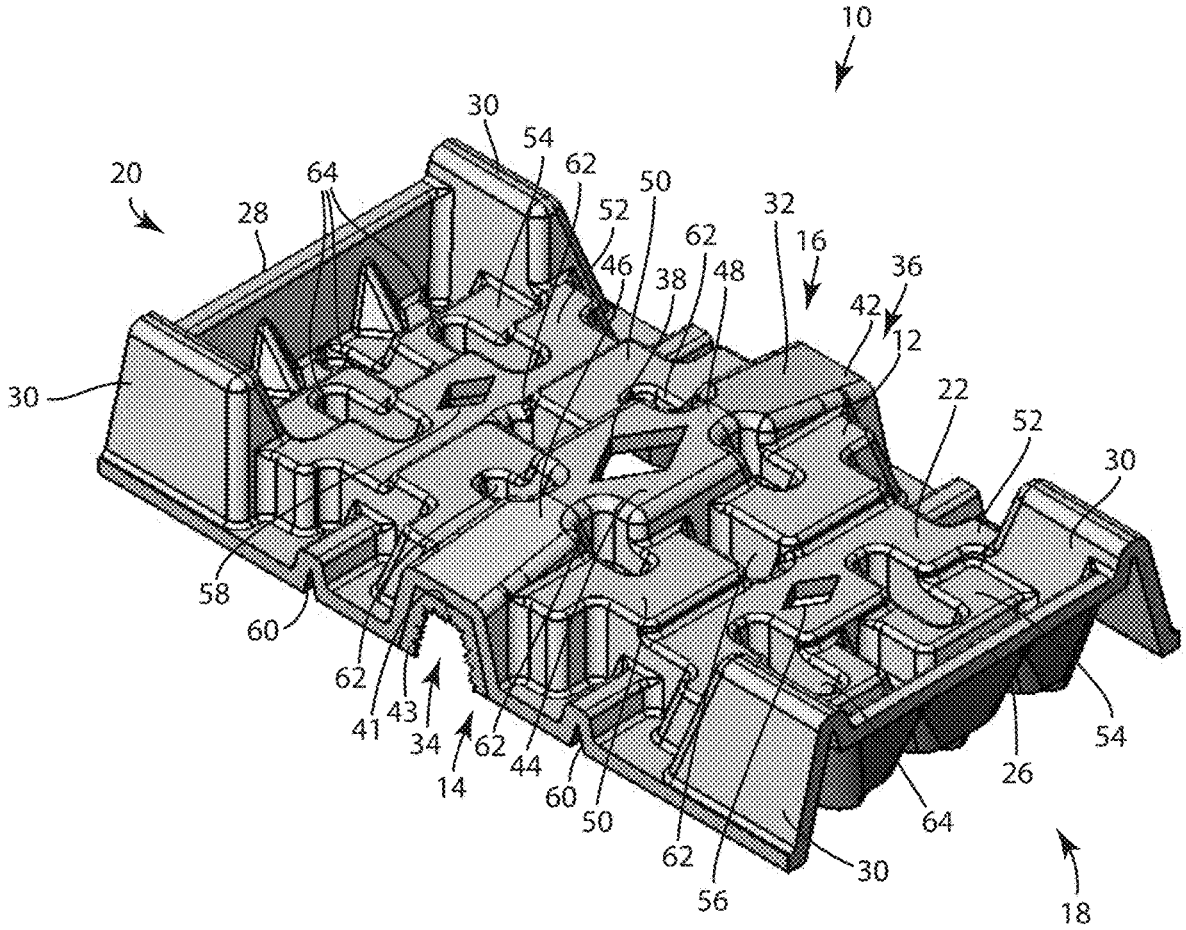
FIG. 1 is a perspective view of a firestarter according to one aspect of the invention.
Figure 2:
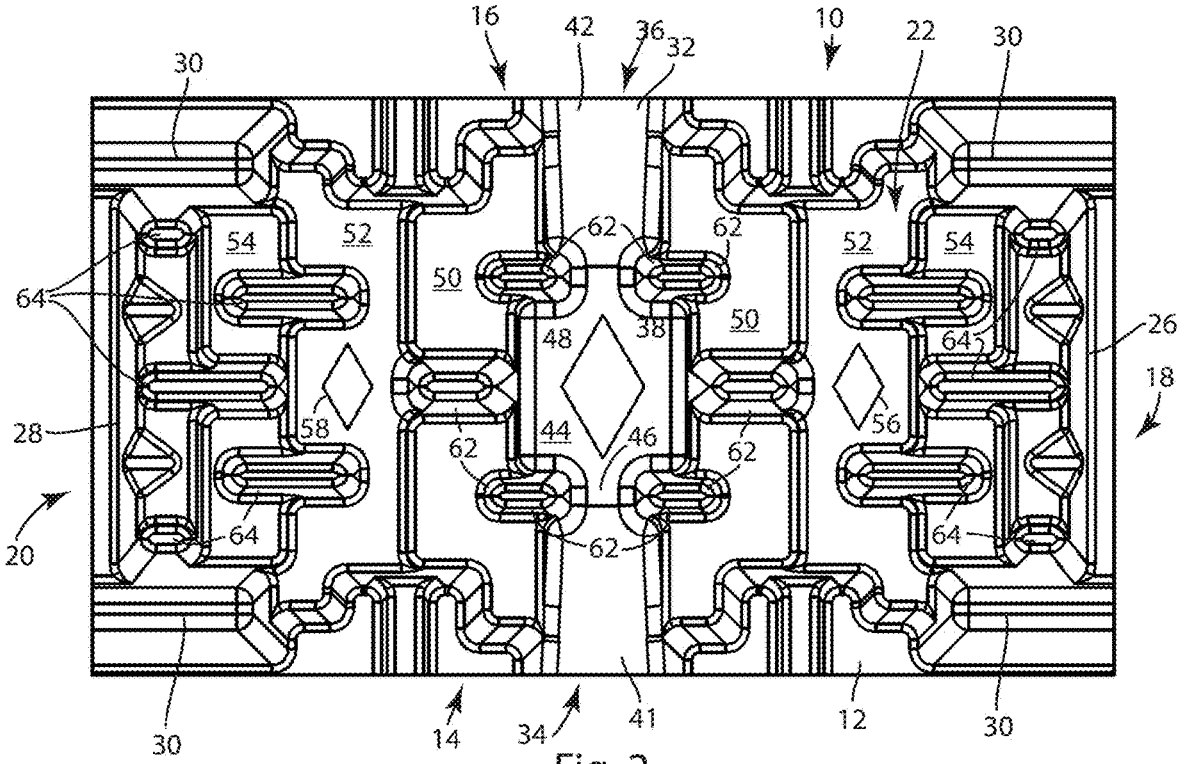
FIG. 2 is a top plan view of the firestarter of FIG. 1.
Figure 3:
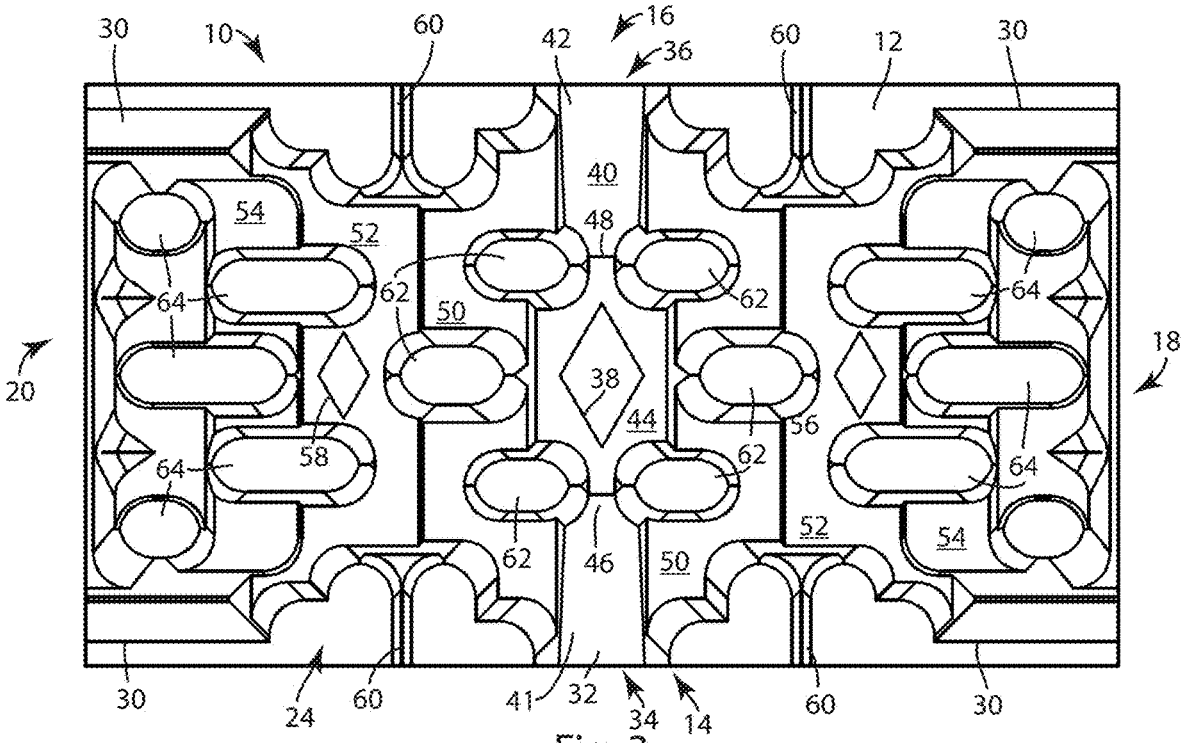
FIG. 3 is a bottom plan view of the firestarter of FIG. 1.
Figure 4:
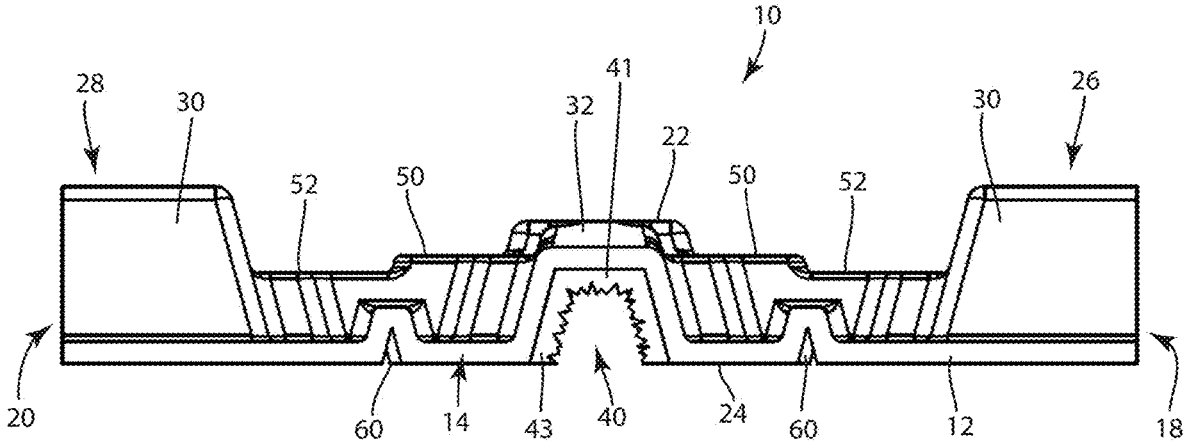
FIG. 4 is a front elevation view of the firestarter of FIG. 1.
Figure 5:
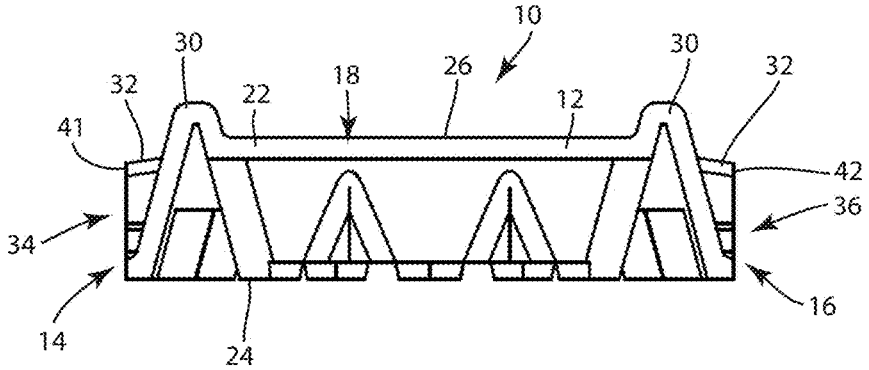
FIG. 5 is a right side elevation view of the firestarter of FIG. 1.

Referring now to FIGS. 1-5, one embodiment of a firestarter 10 is illustrated. The firestarter 10 includes a generally rectangular frame structure in the form of a formed body 12 having a length dimension and a width dimension that define a periphery of the body 12. As shown in the alternative embodiments of FIGS. 6-12, however, the firestarter 10 may take several different shapes and forms and is not limited to any particular form or shape apart from what is recited in the claims. Accordingly, the firestarter 10 extends between a front side 14 and a rear side 16 to define the width dimension and a pair of lateral sides 18 and 20 to define the length dimension. The body 12 also includes a height dimension that varies to form various surface features that will be described in greater detail below. The firestarter 10 has an upper surface 22 (facing upward) and a lower surface 24 (facing downward) that are generally bound by the front side 14, rear side 16, and lateral sides 18 and 20 to define the height dimension as best illustrated in the top and bottom plan views of FIGS. 2 and 3.

The molded body 12 of the firestarter 10 is produced by forming pulped or recycled paper products or other fibrous materials. The forming may be done in a in a tool set. One of several forming processes may be used to create the body 12, including but not limited to, vacuum forming, thermoforming, compression forming, and/or molding a fibrous mixture of organic and/inorganic materials such as pulp and paper products. Because the forming of fibrous materials into structures from a pulp is well-known to those of skill in the art of forming fibrous structures, the specific process used to form the formed body 12 will not be described in greater detail herein. Such processes are commonly used to produce, for example, packaging that is used to support consumer materials inside of boxes for shipping various items.

The formulation for the firestarter 10, however, is different than the formulation of traditional structural inserts and supports made from the conventional forming processes. While both process typically use fibrous materials such as recycled cardboard or newsprint, the firestarter 10 includes additional materials to assist in its function of starting fires. Specifically, the composition of the firestarter includes a wax constituent. In one embodiment, the composition for the firestarter may include 1 to 100 percent by weight of a wax and paper composition, with the remainder of 0 to 99 percent by weight of a fibrous material. In other embodiments, the composition for the firestarter may include 10 to 90 percent by weight of a wax and paper composition, with the remainder of 10 to 90 percent by weight of a fibrous material. In another embodiment, the composition for the firestarter may include 20 to 80 percent by weight of a wax and paper composition, with the remainder of 20 to 80 percent by weight of a fibrous material. In still other embodiments, the composition for the firestarter may include 30 to 70 percent by weight of a wax and paper composition, with the remainder of 30 to 70 percent by weight of a fibrous material. In yet another embodiment, the composition for the firestarter may include 40 to 60 percent by weight of a wax and paper composition, with the remainder of 40 to 60 percent by weight of a fibrous material. In other embodiments, the composition for the firestarter may include 50 percent by weight of a wax and paper composition, with the remainder of 50 percent by weight of a fibrous material. The wax and paper composition, in some embodiments, may be obtained from recycled wax paper, virgin wax paper (white or brown), a combination virgin and recycled wax paper, or from directly mixing a wax with paper. It should be appreciated that the presence of wax and, in particular, paraffin wax, both helps to improve the water resistance of the firestarter 10 to keep the firestarter 10 dry and also facilitates and promotes a long burn time for the firestarter 10.

In one embodiment, the mixture of fibrous materials includes dry strength fluted cardboard, #9 newsprint and/or flyleaf newsprint, preferably with non-hazardous ink, and white wax paper. In another embodiment, the mixture of fibrous materials includes 40% to 50% by weight of recycled wet and/or dry strength fluted cardboard, 10% to 30% by weight #9 newsprint and/or flyleaf newsprint, and 20% to 40% white wax paper. In another embodiment, the fibrous material is obtained from 100% of recycled wax paper. The fibrous material may also be further blended with other or additional virgin and/or recycled fibrous materials, for example, bamboo, cotton, hemp, sawdust, papermaking sludge, and other cellulose-based fibrous materials. The virgin and/or recycled fibrous material may include one or more of the following materials: wood fiber, coir fiber (coconut), sisal fiber, straw fiber, wheat straw fiber, reed fiber, sorghum fiber, rice fiber, cotton fiber, bagasse fiber (sugarcane), waste paper fiber or other recycled fibers, palm fiber, rye grass fiber, switchgrass fiber, bamboo fiber, agwuve fiber (cactus), hemp fiber, miscanthus fiber (elephant grass), banana fiber, corn fiber, orange fiber, cellulose-based fibers, sunflower fiber, lignocellulosic fibers, papyrus fiber, and/or fatwood fiber. Inorganic or organic starches, for example potato starch, may also be added or substituted for some or all of the fibrous materials listed above. The firestarter 10 may further include one or more of the following resins or waxes: fatwood resin (terpene), organic or inorganic waxes or wax emulsions such as vegetable waxes, mineral waxes, microcrystalline waxes, organic waxes, inorganic waxes, synthetic wax emulsions and/or Fisher-Tropsch waxes. The firestarter 10 may also include additional combustible accelerants or "flash" at one or more locations on the body to aid in initial ignition of the firestarter. The firestarter 10 may further include one or more binding agents including, but not limited to: sodium silicate, clay, cellulose gum, lignosulfonates, corn starch, fly ash, hydrated lime, sucrose, and/or calcium aluminate. Paper strengthening agents may also be added to the firestarter 10. While these compositions and ranges are representative, other blends including different waxes and additives might also be utilized without departing from the scope of the disclosure.

Returning now to the structure of the body 12 of the firestarter 10, the contours of the upper surface 22 and the lower surface 24 define various features of the firestarter 10. Generally speaking, the height dimension of the firestarter 10 between the upper surface 22 and the lower surface 24 is generally equal over the body of the firestarter 10, although there may be locally thinned regions in areas designed for initial ignition and/or in order to promote the spreading of the flame after lighting.

Log supports 26 and 28 may be formed adjacent to each of the lateral sides 18 and 20. The log supports 26 and 28 may be widthwise-extending linear, rib-like structures on which logs can be placed so that the logs can rest above the remainder of the upper surface 22 of the firestarter 10, as shown in in FIGS. 1-2, and may include cross-supports 30 oriented at approximately 90 degrees from the direction of extension of the log supports 26 and 28. These cross-supports 30 reinforce the log supports 26 and 28 and improve the buckling resistance of the log supports 26 and 28 after igniting the body 12. In other embodiments, such as that shown in FIGS. 6 and 7, the log supports 26, 28 may comprise tower-like structures at the corners of the body 12 to maintain the logs adjacent to the top surface 22 after igniting the body 12.

Figure 6:
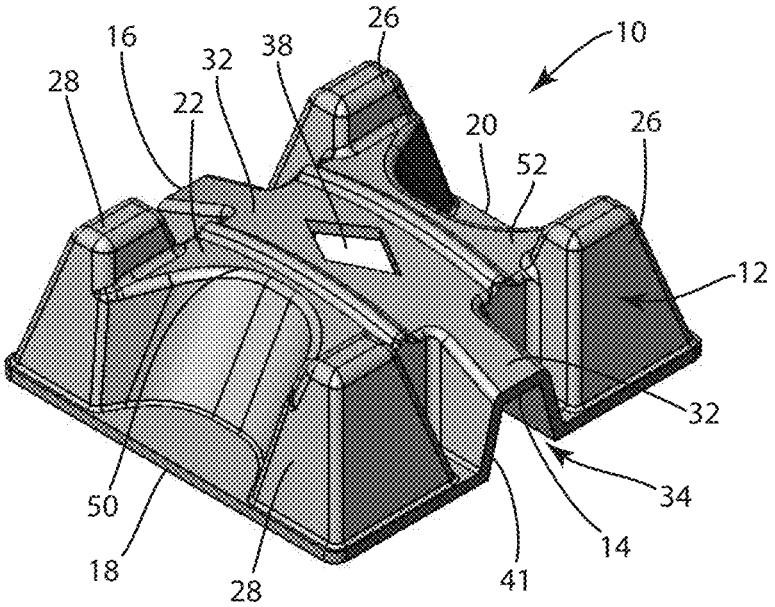
FIG. 6 is a perspective view of a firestarter according to another aspect of the invention.
Figure 7:
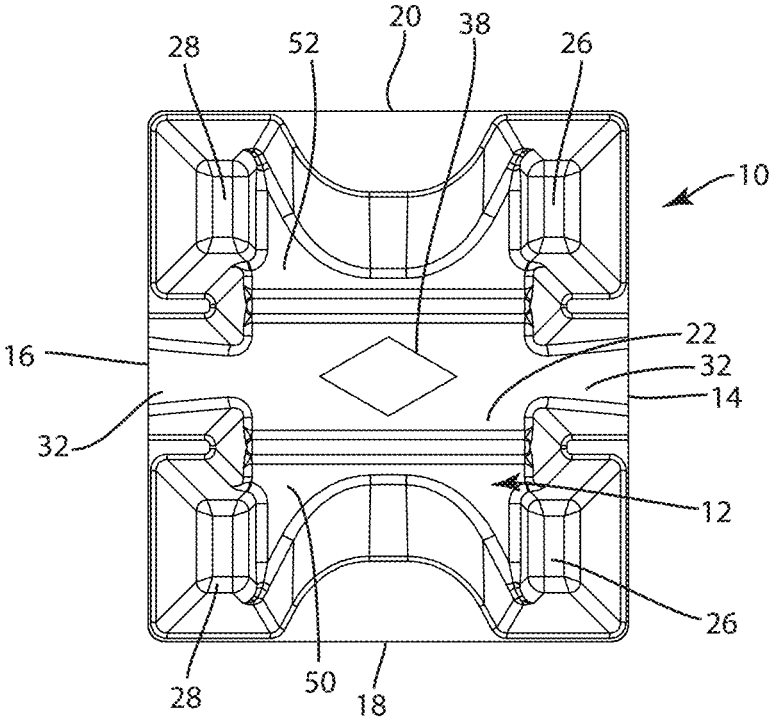
FIG. 7 is a top view of the firestarter of FIG. 6.
Figure 8:
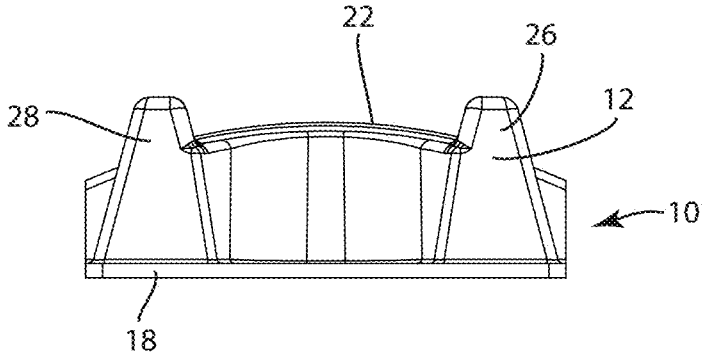
FIG. 8 is a side elevation view of the firestarter of FIG. 6.
Figure 9:
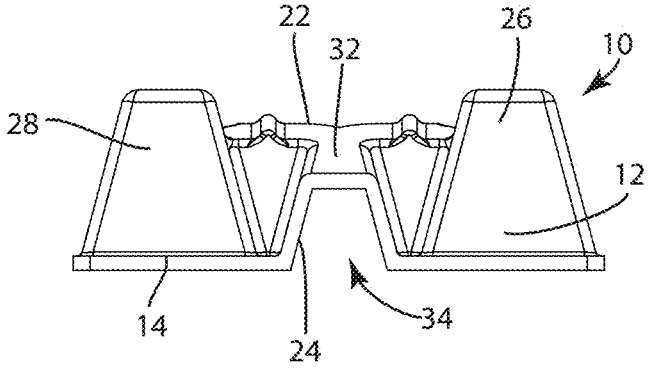
FIG. 9 is a front elevation view of the firestarter of FIG. 6.
Figure 10:
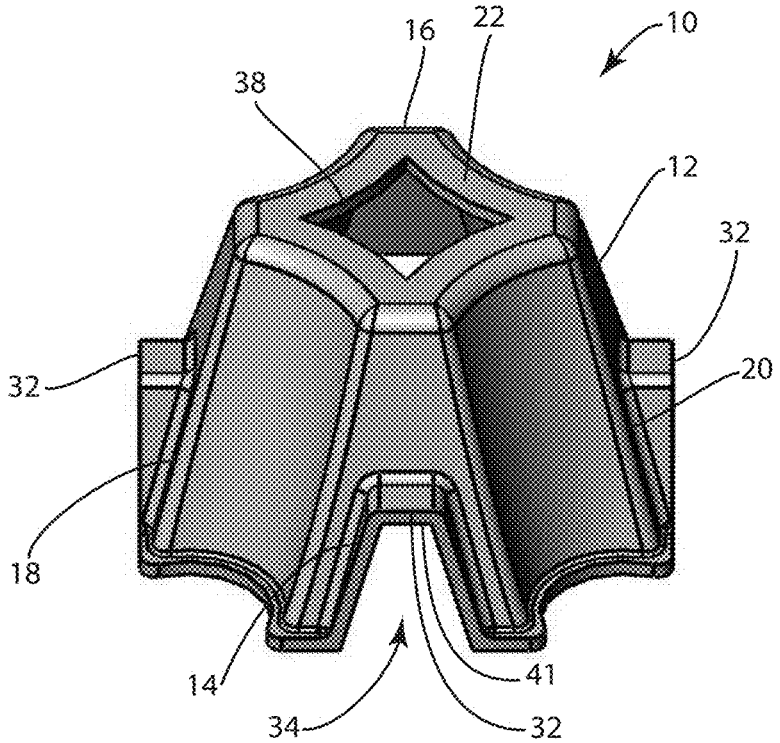
FIG. 10 is a perspective view of a firestarter according to another aspect of the invention.
Figure 11:
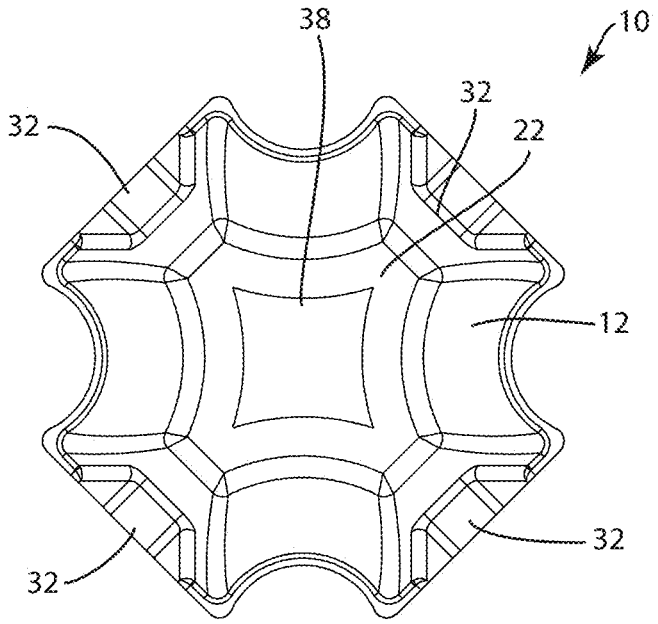
FIG. 11 is a top view of the firestarter of FIG. 10.
Figure 12:
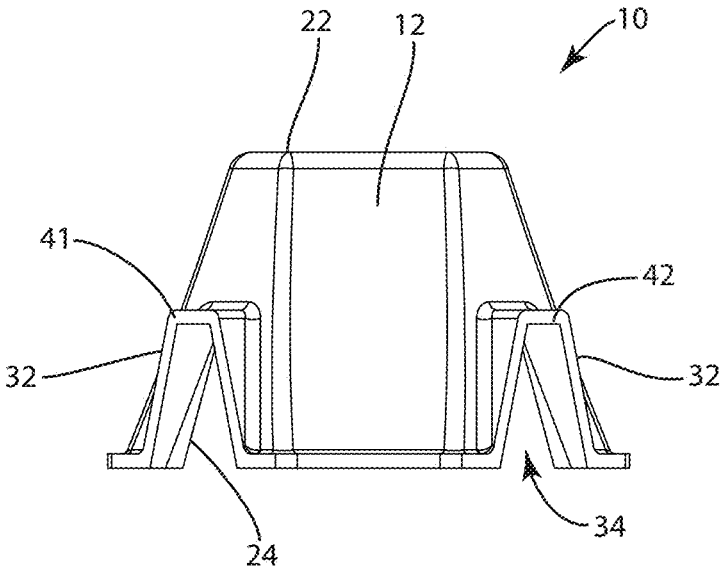
FIG. 12 is a side elevation view of the firestarter of FIG. 10.

Turning now to the surface features, there is at least one flashwick channel 32 extending inwardly from the periphery of the body 12, and in one embodiment, is located halfway between the pair of lateral sides 18 and 20, for example as shown in the embodiments of FIGS. 1-5. Alternatively or in addition, at least one flashwick channel 32 may extend inwardly from additional locations along the periphery of the body 12, including on lateral side 18 or 20 or from a rear side 16. For example and without limitation, the embodiment of FIGS. 10-12 demonstrates flashwick channels 23 extending from four separate locations along the periphery of the body 12. Each flashwick channel 32 extends inwardly in a generally linear fashion from an air inlet 34. In one embodiment, the flashwick channel 32 extends inwardly from a lower air inlet 34 located on the front side 14 to a lower air inlet 36 on the rear side 16 to define a central flashwick channel 32, as shown in FIGS. 1-9. In some embodiments, each flashwick channel 32 arches upwardly as it extends inwardly, as shown in FIGS. 1 and 6. The flashwick channel 32 may include at least one ignition region 41, 42. In one embodiment, ignition regions 41, 42 are located above the lower air inlets 34 and 36, respectively. The ignition regions may have accelerant or flash 43 included or added therein, and/or may be engineered to have very thin wall thickness to promote lighting and consumption by flame. In one embodiment, flash 43 comprises frayed fibers of the fibrous material from which the body 12 is molded to aid in ignition.

The body 12 includes at least one aperture 38, 56, 58 that extends between the upper surface 22 and the lower surface 24. In one embodiment, an aperture 38 is centrally located at the middle of the body 12. In another embodiment, an aperture 38 is located in a flashwick channel 32. While the figures depict apertures 36, 56, 58 in the shape of a diamond, other shapes of apertures could also be used. Accordingly, the precise location and the precise shape of the apertures 38, 56, 58 are not limiting and are exemplary. When at least one flashwick channel 32 extends inwardly from the periphery of the body 12 along the lower surface 24 and connects to at least one air inlet 34, 36, 60 and at least one aperture 38, 56, the channel 32 further defines an air channel 40. In one embodiment, apertures 38, 56, 58 are located at a greater height than the air inlets 34, 36, 60, such that any air traveling from the air inlets 34, 36, 60 to an aperture 38, 56, 58 rises over a distance of the air channel 40. During exemplary use, air can be drawn into the lower air inlets 34 and 36 and travels through air channel 40 under the lower surface 24 toward and out of aperture 38. This air flow helps to continually feed oxygen into the fire during use of the firestarter 10.

In one embodiment, a pair of narrow bridges 46 and 48 may be included between the ignition regions 41 and 42 and a central region 44 which may include a flashwick channel 32. Bridges 46 and 48 may be narrower in a length direction than the adjacent ignition regions 41 and 42 and central region 44. Accordingly, bridges 46 and 48 can retard or slow travel of the flame to and from ignition regions 41, 42 to the central region 44, thereby keeping an aperture 38 located centrally intact for a longer duration of time once lit.

Moving laterally outwardly from the central region 44, in one embodiment the firestarter 10 may include a series of stepped sections 50, 52 and 54 that aid in the stability and rigidity of the formed body 12. In the illustrated embodiment, the stepped sections 50, 52 and 54 are generally symmetric with one another about the central region 44. In one embodiment, medial stepped sections 50 are located adjacent central region 44. Intermediate stepped sections 52 are located laterally outwardly of medial stepped sections 50. Peripheral stepped sections 54 are located laterally outwardly of intermediate stepped sections 52 Log supports 26 and 28 are located outwardly beyond the peripheral stepped sections 54 and on the most distal portion of the lateral ends.

Each of the intermediate stepped sections 52, may include one or more auxiliary apertures 56 and 58 through which air can rise to feed the fire during use. Additional air inlets 60 and additional channels may be formed beneath the lower surface 24 of firestarter 10 such that air that enters through air inlets 34, 36 or 60 travels to and through auxiliary apertures 56 and/or 58. Depressions 62 (or other features) may be locally formed in the firestarter 10 to define a channel or pathway between the air inlets 34, 36, 60 and the auxiliary apertures 56 and 58. Depressions 62 do not necessarily extend entirely to the lowermost plane of the firestarter.

A plurality of feet 64 are located in intermediate stepped section 52 and/or peripheral stepped section 54. Feet 64, which in one embodiment includes a set five feet 64, support the firestarter on a surface. In one embodiment, three of the five feet of each set of feet are located in the peripheral stepped sections 54, while two of the five feet of each set of feet are located in both the intermediate stepped section 52 and the peripheral stepped section 54. The number and location of feet 64 may be modified from the depicted embodiment. The feet 64 define a horizontal resting plane for the firestarter 10 to rest on the ground or other surface such as the base of a fire pit or a fireplace, and add stability and rigidity to the body 12.

It is contemplated that the firestarter 10 of the type disclosed herein may be bundled with logs or natural cord wood to provide a kit for starting a fire. Because the body 12 includes the features described above that make it rigid, it is contemplated that the firestarter 10 would have sufficient structural integrity to be stacked or bundled with firewood. Alternatively, the firestarters could be sold individually or as a stack. Since a set of firestarters 10 would typically all have a similar surface profile, when stacked the features of the firestarter body 12 may nest together. To create the kit, logs are positioned on the log supports 26, 28. A web of material, such as plastic or nylon webbing, is then wrapped around the logs and the firestarter 10 to create the bundled kit. In one embodiment, three logs are used, but the number of logs bundled in the kit is not limiting.

In use, the firestarter 10 is placed on fireplace surface with log supports 26, 28 facing upward. Feet 64, if present, should be facing downwardly and engaging the surface. One or more logs is placed on the log supports 26 and 28. Subsequently, one or both of the ignition regions 41 and 42 are lit by the user using a match or other ignition source. The flame begins to consume the firestarter and travel across flashwick channel(s) 32 and also radiates outwardly towards sides 18, 20. As this occurs, air is continually drawn through the inlets 34, 36 and 60 and travels upwardly towards apertures 38, 56, and 58. This feeds the fire with oxygen. Additionally, some amount of air may be drawn in between the feet 64. During exemplary use, even after flashwick channel(s) 32 have been entirely consumed by flame, it is contemplated that feet 64 may remain intact such that the log supports 26 remain upright for a greater duration of time. Meanwhile, as the flame consumes the structure of firestarter 10, the logs placed on top of the firestarter 10 continue to dry and become heated to the point of the logs themselves becoming ignited. After some duration of time, the firestarter 10 itself is fully consumed; however, by this point, one or more of the logs should be sustainably burning.

It is also contemplated that this firestarter 10 could be used in what is referred to as a "smokeless fire", which means that the material used to ignite the fire is placed on top of the dry logs versus be placed below the logs. Thus, rather than placing the logs on the firestarter 10, the firestarter 10 could potentially be placed over the logs.

It will be appreciated that while a single embodiment is illustrated, many variations are contemplated as falling within the scope of this disclosure. For instance, the number of apertures could potentially vary from the number shown in the illustrated embodiment. Further, the number of other features and their geometric shape and orientation may also be modified. For example, the depressions might be differently arranged in order to provide different air pathways which, in part might be re-designed based on the placement of the apertures. Additionally, the log supports could include downward curvatures to receive e logs. This list of possible variations is exemplary only and not to be considered limiting.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A firestarter comprising:

a body for supporting logs, the body having an upper surface, a downwardly facing lower surface opposite the upper surface and defining an external bottom surface, a length dimension extending between a pair of opposing lateral sides, and a width dimension extending between a pair of opposing front and rear sides, the opposing lateral sides and the opposing front and rear sides defining an periphery of the body;

at least one aperture extending between the lower surface and the upper surface of the body;

a set of feet extending downwardly from the lower surface to engage a supporting surface and defining a horizontal resting plane for the firestarter and spacing the external bottom surface above the supporting surface;

at least two log supports integral with the body and extending upwardly along the width dimension and located adjacent to the periphery at the opposing lateral sides of the body, the log supports configured to support at least one log above the upper surface of the body, each log support further including at least one cross support oriented at approximately 90 degrees from the direction of extension of the log support;

at least one air inlet having an ignition region located at the periphery of one of the front, rear or lateral sides to flow air to the lower surface, the air inlet further defining a channel extending along the external bottom surface of the lower surface between the ignition region and at least one aperture and configured to permit air to flow from the ignition region to at least one aperture along the external bottom surface, the air inlet and channel being centrally located between the opposing lateral sides of the body;

wherein a portion of the channel includes accelerant or flash to aid in ignition and wherein the ignition region located at an outer periphery of the body is 1/128ths of an inch to 3/8ths of an inch in thickness.

2. The firestarter of claim 1, wherein the channel extends between a first lower air inlet formed on a first lateral side and a second lower air inlet formed on a second, opposing lateral side to provide an air channel extending between opposing lateral sides.

3. The firestarter of claim 1, wherein the channel extends between a first lower air inlet formed on the front side and a second lower air inlet formed on the rear side to provide an air channel extending between the front and rear sides.

4. The firestarter of claim 1, wherein the channel extends between opposing sides of the periphery of the body along the external bottom surface of the lower surface, and further wherein the body includes at least one downwardly stepped region extending peripherally from the flashwick channel towards the lateral sides.

5. The firestarter of claim 4, further comprising at least one auxiliary aperture extending between the lower surface and the upper surface.

6. The firestarter of claim 5, wherein the at least one auxiliary aperture is formed through at least one of the downwardly stepped regions.

7. The firestarter of claim 4, wherein the pair of log supports are at greater height than the downwardly stepped portions.

8. The firestarter of claim 1, further comprising at least one auxiliary aperture extending between the lower surface and the upper surface, and a plurality of depressions on the lower surface of the body defining auxiliary air channels from an air inlet to the at least one auxiliary aperture.

9. The firestarter of claim 1, wherein the body is formed from a blend of fibrous materials and wax, wherein the wax provides water resistance and promotes a longer burn time of the body.

10. The firestarter of claim 9, wherein the blend of fibrous materials and wax is 40% to 50% by weight cardboard, 10% to 30% by weight newsprint, and 20% to 40% wax paper.

11. The firestarter of claim 9, wherein the blend of fibrous materials and wax is 50% by weight cardboard, 20% by weight newsprint, and 30% wax paper.

12. The firestarter of claim 9, wherein the blend of fibrous materials and wax comprises 100% wax paper.

13. The firestarter of claim 9, wherein the fibrous material is selected from the group consisting of: wood fiber, coir fiber, sisal fiber, straw fiber, wheat straw fiber, reed fiber, sorghum fiber, rice fiber, cotton fiber, bagasse fiber, waste paper fiber or other recycled fibers, palm fiber, rye grass fiber, switchgrass fiber, bamboo fiber, agwuve fiber, hemp fiber, miscanthus fiber, banana fiber, corn fiber, orange fiber, cellulose-based fibers, sunflower fiber, lignocellulosic fibers, papyrus fiber, and fatwood fiber; and the wax is selected from the group consisting of: paraffin wax, fatwood resin, vegetable waxes, mineral waxes, microcrystalline waxes, organic waxes, inorganic waxes, synthetic wax emulsions, and Fisher-Tropsch waxes.

14. A firestarter comprising:

a body formed from a blend of fibrous materials and wax having 40% to 50% by weight cardboard, 10% to 30% by weight newsprint, and 20% to 40% wax paper;

the body having an upper surface, a downwardly facing lower surface opposite the upper surface, a length dimension extending between a pair of opposing lateral sides, and a width dimension extending between a pair of opposing front and rear sides, the opposing lateral sides and the opposing front and rear sides defining an periphery of the body;

a plurality of apertures extending between the lower surface and the upper surface of the body, one aperture being centrally located and equidistant from the opposing lateral sides and the front and back sides;

a set of feet extending downwardly from the lower surface to engage a supporting surface and spacing the lower surface above the supporting surface and;

two air inlets centrally located at the front and rear sides to flow air to the lower surface of the body, the air inlets having an ignition region located at the periphery of one of the front, rear or lateral sides to flow air to the lower surface, each air inlet further defining a channel extending along the external bottom surface of the lower surface between the ignition region and the centrally located aperture and configured to permit air to flow from the ignition region to at least one aperture along the external bottom surface;

at least two log supports integral with the body an extending upwardly along the width dimension and located at the opposing lateral sides of the body, the log supports configured to support at least one log above the centrally located aperture, each log support further including at least one cross support oriented at approximately 90 degrees from the direction of extension of the log support, the log supports operable such that logs placed thereon remain in place after the firestarter is consumed; and wherein a portion of the channel includes accelerant or flash to aid in ignition and wherein each ignition region located at an outer periphery of the body is 1/128ths of an inch to 3/8ths of an inch in thickness.

15. The firestarter of claim 14 wherein the blend of fibrous materials and wax is 50% by weight cardboard, 20% by weight newsprint, and 30% wax paper.

16. The firestarter of claim 14, wherein the fibrous material is selected from the group consisting of: wood fiber, coir fiber, sisal fiber, straw fiber, wheat straw fiber, reed fiber, sorghum fiber, rice fiber, cotton fiber, bagasse fiber, waste paper fiber or other recycled fibers, palm fiber, rye grass fiber, switchgrass fiber, bamboo fiber, agwuve fiber, hemp fiber, miscanthus fiber, banana fiber, corn fiber, orange fiber, cellulose-based fibers, sunflower fiber, lignocellulosic fibers, papyrus fiber, and fatwood fiber; and the wax is selected from the group consisting of: paraffin wax, fatwood resin, vegetable waxes, mineral waxes, microcrystalline waxes, organic waxes, inorganic waxes, synthetic wax emulsions, and Fisher-Tropsch waxes.

17. The firestarter of claim 14, wherein the channel extends between opposing sides of the periphery of the body along the external bottom surface of the lower surface; wherein the body includes at least one downwardly stepped region extending a peripherally from the channel towards the lateral sides of the body, each downwardly stepped region including one of the plurality of apertures, each of the plurality of apertures being centrally located on the downwardly stepped region between the front and back sides of the body.

* * * * *